US006318283B1

(12) United States Patent
Coulthard, Jr.

(10) Patent No.: US 6,318,283 B1
(45) Date of Patent: Nov. 20, 2001

(54) METHOD AND APPARATUS FOR MARKING FABRIC

(75) Inventor: Robert Stanley Coulthard, Jr., Lynn Haven, FL (US)

(73) Assignee: Common Sense Systems Inc., Lynn Haven, FL (US)

( * ) Notice: Subject to any disclaimer, the term of this patent is extended or adjusted under 35 U.S.C. 154(b) by 0 days.

(21) Appl. No.: 09/613,620

(22) Filed: Jul. 11, 2000

(51) Int. Cl.[7] ..... D05B 5/00; A41B 11/00

(52) U.S. Cl. ..... 112/475.12; 112/475.14; 112/104; 2/239; 24/530; 40/663; 206/343

(58) Field of Search ..... 112/475.14, 475.12, 112/131, 169; 2/239, 240, 241; 24/662, 90 C, DIG. 29, 453, 462, 530, 532; 206/338, 343–347

(56) References Cited

U.S. PATENT DOCUMENTS

| | | | | |
|---|---|---|---|---|
| 3,103,666 | * | 9/1963 | Bone . | |
| 3,470,834 | * | 10/1969 | Bone | 112/169 X |
| 3,651,545 | * | 3/1972 | Hara . | |
| 4,058,853 | | 11/1977 | Boxer et al. . | |
| 4,344,240 | | 8/1982 | Schiller . | |
| 4,821,883 | | 4/1989 | Miller . | |
| 5,038,413 | | 8/1991 | Ursino . | |
| 5,095,596 | | 3/1992 | Dahood . | |
| 5,357,660 | | 10/1994 | Smith . | |
| 5,367,809 | | 11/1994 | Ross . | |
| 5,467,510 | | 11/1995 | Hartzell . | |
| 6,032,294 | * | 3/2000 | Dean | 2/239 |
| 6,067,659 | | 5/2000 | Reichle . | |
| 6,135,425 | * | 10/2000 | Platt . | |

* cited by examiner

*Primary Examiner*—Ismael Izaguirre
(74) *Attorney, Agent, or Firm*—Jones, Tullar & Cooper, PC

(57) ABSTRACT

A method and apparatus for marking fabric in a permanent or semipermanent manner includes a plurality of foam markers which are compressible to a smaller size. Upon release of external pressure, the foam markers expand to their original shape and volume. An insertion tool is provided for inserting the foam markers into fabric. The insertion tool comprises an elongate tubular member which has a marker receiving opening on a first end. A pointed tip is located on the second end of the insertion tool to facilitate insertion of the tool between the threads of the fabric being marked. A marker may be compressed by rolling the marker between a thumb and finger. The compressed marker is then partially inserted into the opening of the insertion tool so that a portion of the marker protrudes from the end of the insertion tool. The tip of the insertion tool is then inserted through the fabric at a desired location. As the tool is passed completely through the fabric, the portion of the marker protruding from the end of the tool catches on the fabric. The marker is pulled out of the tool so that the second side of the marker is located on the opposite side of the fabric from the first side of the marker. The marker swells back toward its original volume so that the marker is firmly retained within the fabric. The system may be used to match socks by placing matching markers in a matched sock pair. The system may also be used to create decorative patterns in fabric for various type of arts and crafts.

10 Claims, 2 Drawing Sheets

METHOD AND APPARATUS FOR MARKING FABRIC

BACKGROUND OF THE INVENTION

1. Field of the Invention

The present invention generally relates to a method and apparatus for marking fabric with colored markers. In one aspect, the system may be applied to producing decorative patterns in cloth. Under an additional aspect, the system may be used for placing markers in articles of clothing, such as socks, to facilitate matching of one sock with the other sock of a pair of socks.

2. Description of the Prior Art

In the past, numerous attempts have been made to provide an easily-implemented means for marking cloth or fabrics in a permanent or semipermanent manner. These attempts have included the use of dyes, paints, and other compositions, but such compositions are not always convenient or easy to apply, are not always permanent, and are often unsatisfactory for other reasons. In addition, there have been numerous mechanical marking means implemented in the past, such as tags, patches, plastic snaps, rivet-type elements, and the like. But these mechanical marking means are often overly complex, difficult to apply, or can be irritating to the skin when attached to clothing.

One problem in particular which the present invention addresses is the marking of hosiery so as to enable the matching of one sock of a pair of socks with the corresponding sock from that pair. There are several variables that complicate this problem. First, many people have some degree of difficulty in distinguishing dark colors, such as black and navy, particularly in low-light conditions. Secondly, in a family, there may be several individuals who wear the same size and style of hosiery, making it difficult to recognize to whom a particular pair of socks may belong. In addition, slight variations in sock style, weave pattern, size, and texture are not always readily apparent to the person sorting the laundry, and can result in mismatched pairs of socks. Accordingly, one application for the present invention is to provide an inexpensive, convenient means for marking socks so that matching pairs of socks may be easily identified.

Another use for the present invention is in the area of crafts, and, in particular, in the production of decorative crafts similar to those produced by needle point and embroidery. One consideration with the prior art in this field is that such crafts are generally considered unsuitable for young children because of the necessity of sharp needles for sewing yarn or thread into a pattern. In addition, the various stitching techniques, types of stitches, and the like, are also often too difficult for young children to master. Under the system of the invention, however, decorative patterns may be easily and safely created in fabrics for a variety of craft-type applications, such as T-shirt decoration, needlepoint-like artwork, and the like.

SUMMARY OF THE INVENTION

Under a broad aspect, the present invention sets forth a method and apparatus for marking fabric in a permanent or semipermanent manner. The invention includes a plurality of foam markers which are compressible to a smaller size. Upon release of external pressure, the foam markers tend to expand to their original shape and volume. An insertion tool is provided for inserting the foam markers into fabric. The insertion tool comprises an elongate tubular member which has a marker-receiving opening on a first end. A pointed tip is located on the second end of the insertion tool to facilitate insertion of the tool between the threads of the fabric being marked.

A marker may be compressed by rolling the marker between a thumb and finger. The compressed marker is then partially inserted into the open first end of the insertion tool so that a portion of the marker protrudes from the first end of the insertion tool. The portion of the marker which extends from the opening of the tool tends to swell back toward its original volume while the marker remains retained within the insertion tool. The pointed tip of the insertion tool is then inserted through the fabric at a desired location. As the tool is passed completely through the fabric, the portion of the marker protruding from the end of the tool catches on the fabric. The marker is pulled out of the open first end of the tool so that the other side of the marker is located on the opposite side of the fabric from the first portion of the marker. The other side of the marker swells back toward its original volume so that the marker is firmly retained within the fabric. The marker may advantageously be formed having an hour glass shape so that the marker is more securely retained in the fabric.

The above-described system may be used to match socks by placing matching markers in the socks of a matching pair of socks. The matching markers are preferably of a matching color, and may be placed in matching locations on the matching sock pair. In addition, two or more markers may be placed in each sock to increase the variety of identifying indicia created by the system of the invention. For example, four white markers may be placed in each sock of a pair of black socks. Alternatively, one red and one white marker may be placed in each sock of a pair of socks. Accordingly, it will be apparent that numerous combinations and variations can be created with the markers of the present invention.

Under an additional aspect, the invention may be used to create decorative patterns in fabrics. For example, a piece of fabric may be provided having a preprinted pattern formed on its surface. Instructions may be provided for inserting markers of particular colors into particular areas of the fabric for creating a colored decorative article. This system is particularly suitable for younger children, as they are able to roll and compress the markers and use the insertion tool without risk of injury from needles or the like. Because the insertion tool of the invention is preferably constructed of relatively soft plastic, parents do not have to worry about the children handling sharp objects or the other aforementioned shortcomings of the prior art in this area.

BRIEF DESCRIPTION OF THE DRAWINGS

The foregoing and additional objects, features, and advantages of the present invention will become apparent to those of skill in the art from a consideration of the following detailed description of preferred embodiments of the invention, taken in conjunction with the accompanying drawings.

DETAILED DESCRIPTION

Figure 1:
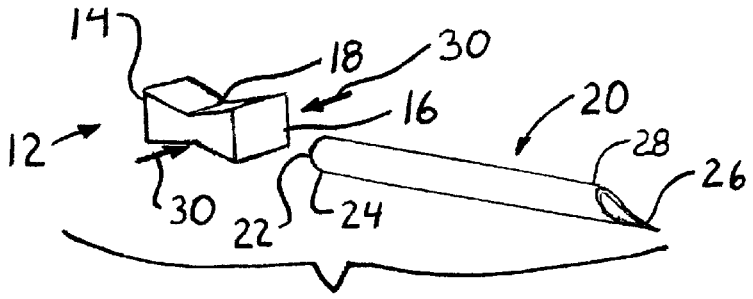
FIG. 1 illustrates a marker and an insertion tool of the invention prior to compression of the marker.

The present invention sets forth a method and apparatus for marking fabric. As illustrated in FIG. 1, the system includes one or more foam markers 12 which are compressed, inserted into fabric, and retained in the fabric by the expansion action of the foam. Foam markers 12 include a first end 14 and a second end 16. First end 14 is preferably, but not necessarily, of the same size and shape as second end 16. Ends 14, 16 are square in the preferred embodiment, but generally may be formed in any desired shape, such as circular, triangular, rectangular, spherical, etc. Foam markers 12 are advantageously formed having a central portion 18 of reduced cross section, such as an hourglass shape or other shape which is smaller in cross-sectional area than ends 14, 16. This reduced-size central portion 18 helps markers 12 be retained in place more securely following insertion of markers 12 into a piece of fabric.

Markers 12 are preferably constructed from polyurethane foam, such as the type commonly used to manufacture earplugs, and are supplied in a variety of colors. This foam material has the capability of being compressed to a smaller shape, generally holding the compressed shape briefly, and then expanding back to its original configuration. Of course, other types of polymer foams, sponges, and the like may also be used to produce the markers of the present invention. An additional advantage of the foam of the present invention is that it is soft and resilient so that it is not normally perceptible when worn against the skin of an individual, such as when a marker of the invention is installed in a sock, an application of the invention that will be discussed in greater detail below.

An insertion tool 20 is also provided under the system of the invention. Insertion tool 20 is an elongate hollow body having an opening 22 on an open first end 24 for receiving a marker 12. A pointed tip 26 is located at the second end 28 of tool 20, and is useful to facilitate penetration of insertion tool 20 through a piece of fabric. Insertion tool 20 is preferably constructed from a plastic, such as is used in drinking straws, although other suitable materials may also be used. The plastic may be transparent or translucent to allow the user to see how much of a marker 12 is inserted into opening 22. It is desirable, however, where the invention is to be used by children, for the insertion tool 20 to be constructed of a plastic that is sufficiently soft so that the tip cannot penetrate skin or otherwise inflict physical injury.

Figure 2:
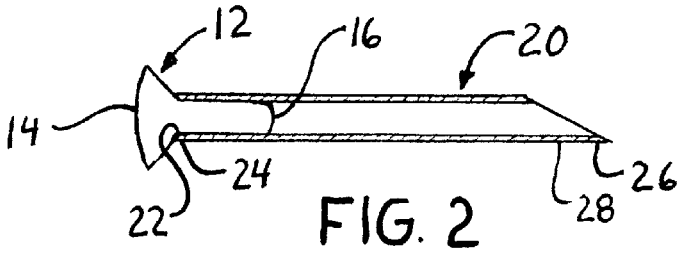
FIG. 2 illustrates a cross sectional view of the insertion tool having a marker compressed and partially protruding from an open first end of the tool.

In use, as illustrated in FIG. 1, marker 12 is compressed generally in the direction of arrows 30, by squeezing and rolling marker 12 between a thumb and finger, although other compression means may also be used. Second end 16 of marker 12 is then inserted into insertion tool 20 in an endwise manner, as illustrated in FIG. 2, so that first marker end 14 protrudes from insertion tool opening 22 on first end 24. It is desirable to compress marker 12 in a direction transverse to the hour glass shape of reduced-cross-section portion 18 so that one of either of marker ends 14, 16, protrudes from end opening 22. Upon insertion of marker 12 into insertion tool 20, marker 12 will expand slightly to fill the interior of opening 22, and marker 12 is thereby retained within tool 20 by the friction created by the expansion force of marker 12.

Figure 3A:
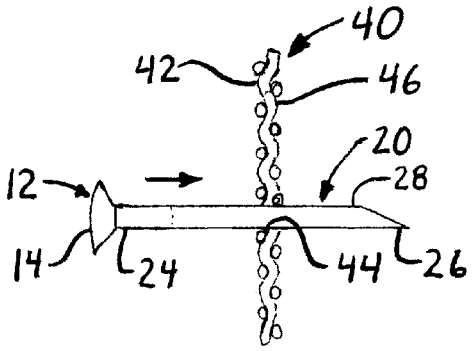
FIG. 3*a* illustrates the insertion tool and marker of FIG. 2 as it is being passed through a portion of fabric.
Figure 3B:
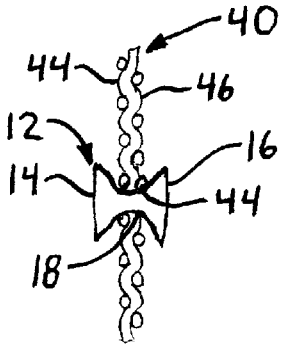
FIG. 3*b* illustrates the marker of FIG. 3*a* following passage of the insertion tool through the fabric, with the marker emplaced in the fabric and re-expanded toward its original volume.

As illustrated in FIGS. 3*a* and 3*b*, marker 12 is inserted into a piece of fabric 40 by penetrating a first side 42 of fabric 40 at a desired location with tip 26. Tip 26 will pass through the weave of fabric 40, and "stretch" the threads of the fabric at that point to enlarge a hole 44, preferably without tearing the fabric or breaking any threads. As tool 20 is passed through fabric 40, from first side 42 to the second side 46, first marker end 14 of marker 12 will contact first side 42 of fabric 40. Since first marker end 14 is larger than hole 44, first marker end 14 of marker 12 will not pass through hole 44. As insertion tool 20 continues to pass through fabric 40, the friction retaining marker 12 within tool 20 is overcome, and tool 20 is pulled off of second marker end 16. This occurs after second marker end 16 has already passed through hole 44, and second marker end 16 then expands back toward its original shape on the second side 46 of fabric 40. Thus, first marker end 14 is expanded on the first side 42 of fabric 40 and the second marker end 16 is expanded on the second side of fabric 40, with marker central portion 18 being retained in hole 44. In this condition, marker 12 is securely retained within fabric 40. Experiments have shown that marker 12 will not be dislodged through normal use, such as wearing with apparel or placement in household washing machines and dryers.

Figure 4:
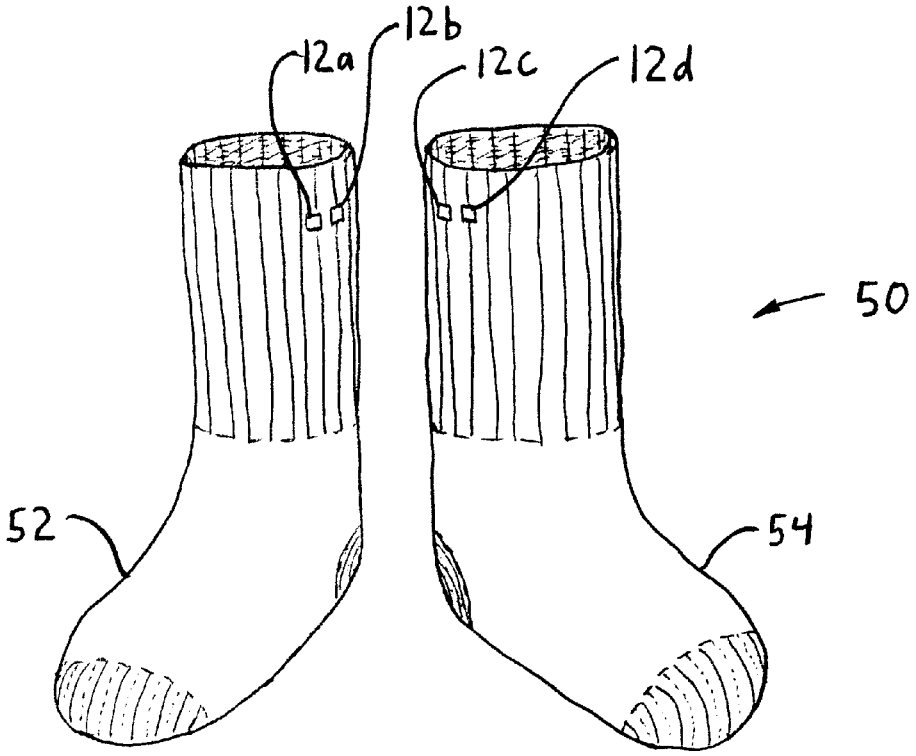
FIG. 4 illustrates a first preferred application of the present invention for use in matching one sock with its corresponding sock of a pair of socks.

In a preferred aspect of the invention, the system may be used to mark socks so as to enable easy and convenient matching of mating sock pairs. As illustrated in FIG. 4, a pair of socks 50 includes a first sock 52 and a second sock 54. Markers 12*a*, 12*b*, have been placed in sock 52, and markers 12*c*, 12*d* have been placed in sock 54 in the manner described above. Markers 12*a* and 12*b* preferably match in color markers 12*c* and 12*d*. All of markers 12*a*–12*d* may be the same color, but preferably of a color which contrasts from the color of socks 50. For example, markers 12*a*–12*d* may be red, while socks 50 may be black. Thus, when a person is sorting laundry, when a first one of socks 52, 54 is located, it is merely necessary to look for another sock having two red markers. Alternatively, combinations of colored markers 12 may be used. For example, markers 12*a* and 12*c* may be white, and markers 12*b* and 12*d* may be red, so that each sock 52, 54 has one red marker and one white marker. Under yet another example, where there are two or more individuals with similar styles of socks, one individual's socks may be marked with two markers per sock, another's with three markers per sock, etc. Also, one individuals's socks may be marked in a first location on the socks, while another individual's socks may be marked in a second location on the socks. Numerous other variations in the system of the invention will be apparent to those skilled in the art, and it is to be understood that the above description is only exemplary of the invention.

Figure 5:
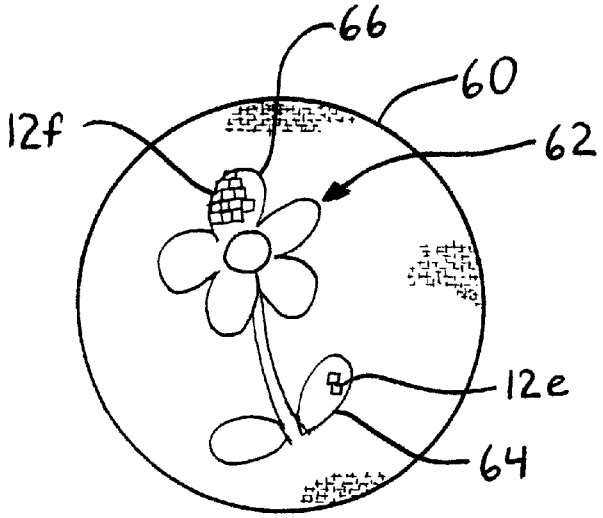
FIG. 5 illustrates a second preferred application of the present invention as used for creating decorative crafts.

Under an additional aspect of the invention, the system of the invention may be used to create decorative designs in fabrics. As illustrated in FIG. 5, a piece of fabric 60 is provided for receiving markers 12. Fabric 60 preferably has a design 62 preprinted on its surface 64, although such is not absolutely required for carrying out the invention, as an individual may choose to create an original design. Design 62 may include instructions for inserting markers 12 of different colors into fabric 60 at different locations. For example, in the flower design 62 illustrated, green markers 12*e* may be inserted into a leaf portion 64 of the flower design 62, while white or yellow markers 12*f* may be inserted into a petal portion 66 of flower design 62. In this manner, any sort of decorative pattern may be created in fabric using the markers and system of the invention, and products so created may be framed, worn as clothing, or the like.

Also, it will be apparent that the markers and insertion tool may be supplied in a variety of sizes to accommodate different common weave patterns for a various types of fabrics. Accordingly, while the foregoing disclosure sets forth exemplary embodiments of the present invention, it is to be understood that the invention is not limited to the particulars of the foregoing embodiments, but is limited in scope only as set forth in the following claims.

What is claimed:

1. A method for marking fabric comprising:

providing a compressible marker having a first end and a second end;

providing an insertion tool having an open end;

compressing the marker and inserting the second end of the marker into the open end of the insertion tool so that the first end of the marker protrudes from the insertion tool; and passing the insertion tool through the fabric to be marked so that the first end of the marker contacts the fabric and the marker is retained within the fabric as the insertion tool is passed through the fabric.

2. The method of claim 1 further including the step of providing a point on the insertion tool so that the insertion tool more easily penetrates the fabric.

3. The method of claim 1 wherein the step of compressing the marker includes the step of rolling the marker between a thumb and finger to compress the marker.

4. The method of claim 1 wherein the fabric is a first sock, and further including the steps of repeating the foregoing steps to mark a second sock which matches said first sock as part of a matched pair of socks.

5. The method of claim 1 further including the step of repeating the foregoing steps to create a decorative pattern in the fabric.

6. A fabric marking apparatus comprising:

a marker of a compressible foam material, said marker including a first end, as second end, and a reduced cross section portion located therebetween, said marker being compressible for insertion into fabric and expandable following insertion so that said marker is retained within the fabric.

7. The apparatus of claim 6 further including an insertion tool having an opening for receiving said marker when said marker is in a compressed state.

8. The apparatus of claim 7 wherein said insertion tool has a pointed tip for facilitating insertion of said insertion tool through fabric.

9. The apparatus of claim 6 wherein said reduced cross section portion of said marker is generally in the shape of an hourglass.

10. A method for marking socks to make it easier to match one sock of a pair with the other sock of that pair, said method comprising:

providing at least two compressible foam markers of a predetermined color different from the color of said socks, said markers having a first end and a second end;

providing an insertion tool, said insertion tool having an open end for receiving a compressed marker;

compressing a first marker and placing said first marker into the open end of said insertion tool;

passing the insertion tool though a portion of a first of said socks whereby said first marker is pulled out of said tool while passing through said portion of said first sock, and said marker expands so as to be retained in said portion of said sock;

compressing a second marker and placing said second marker into the open end of said insertion tool;

passing the insertion tool though a portion of the second of said socks whereby said second marker is pulled out of said tool while passing through said portion of said second sock, and said second marker expands so as to be retained in said portion of said second sock, whereby said first sock may be matched with said second sock by matching said first marker with said second marker.

* * * * *